US008726506B2

(12) United States Patent
Yang

(10) Patent No.: US 8,726,506 B2
(45) Date of Patent: May 20, 2014

(54) HEAT PIPE AND METHOD FOR FORMING THE SAME

(75) Inventor: Hsiuwei Yang, Sinjhuang (TW)

(73) Assignee: Asia Vital Components Co., Ltd., New Taipei (TW)

( * ) Notice: Subject to any disclaimer, the term of this patent is extended or adjusted under 35 U.S.C. 154(b) by 174 days.

(21) Appl. No.: 13/366,800

(22) Filed: Feb. 6, 2012

(65) Prior Publication Data

US 2012/0131798 A1 May 31, 2012

Related U.S. Application Data

(63) Continuation of application No. 12/082,703, filed on Apr. 11, 2008, now Pat. No. 8,196,301.

(30) Foreign Application Priority Data

Dec. 18, 2007 (TW) ..... 96148372 A

(51) Int. Cl.
*B23P 6/00* (2006.01)

(52) U.S. Cl.
USPC ..... 29/890.032

(58) Field of Classification Search
USPC ..... 29/890.032, 890.038; 174/15.2; 165/178, 272; 403/68, 187
See application file for complete search history.

(56) References Cited

U.S. PATENT DOCUMENTS

| | | | | |
|---|---|---|---|---|
| 4,195,808 | A | 4/1980 | Anderson | |
| 4,541,261 | A | 9/1985 | Yanadori et al. | |
| 4,620,590 | A | 11/1986 | Koisuka et al. | |
| 5,054,196 | A | 10/1991 | Sakaya et al. | |
| 6,313,451 | B1 | 11/2001 | Vidmar et al. | |
| 6,370,749 | B1 | 4/2002 | Tseng et al. | |
| 7,494,160 | B2 | 2/2009 | Lin et al. | |
| 7,543,380 | B2 | 6/2009 | Hou et al. | |
| 2003/0094274 | A1 | 5/2003 | Toth et al. | |
| 2003/0196778 | A1 | 10/2003 | Kobayashi et al. | |
| 2005/0145380 | A1 | 7/2005 | Usui | |
| 2006/0044804 | A1 * | 3/2006 | Ono et al. | 362/294 |
| 2007/0062036 | A1 * | 3/2007 | Tung et al. | 29/890.032 |
| 2007/0215327 | A1 | 9/2007 | Lai et al. | |
| 2008/0055854 | A1 | 3/2008 | Zhou et al. | |
| 2009/0040726 | A1 * | 2/2009 | Hoffman et al. | 361/700 |

* cited by examiner

*Primary Examiner* — David Bryant
*Assistant Examiner* — Moshe Wilensky

(57) ABSTRACT

A heat pipe and a method for forming the same are provided. The method includes: defining a closed end, a closed portion, and a contact section in sequence along a heat pipe to be processed; closing the opening of the closed end and the passage of the closed portion so as to finalize the heat pipe; and cutting axially the contact section into a plurality of equal parts, bending the equal parts outward to assume a divergent shape, thereby providing the contact section with an area for contact with a heat-generating source. Heat is directly transferred from the heat-generating source to the heat pipe via the contact section, thereby enhancing heat dissipation.

2 Claims, 9 Drawing Sheets

(C)

(D)

(A)

(B)

HEAT PIPE AND METHOD FOR FORMING THE SAME

CROSS-REFERENCE TO RELATED APPLICATIONS

The present application is a continuation of U.S. patent application Ser. No. 12/083,703, filed on Apr. 11, 2008, titled Heat Pipe and Method for Forming the same, listing Hsiuwei Yang as inventor.

BACKGROUND OF THE INVENTION

1. Field of the Invention

The present invention relates to a heat pipe and a method for forming the same, more particularly, to a method for manufacturing a heat pipe highly efficient in heat transfer.

2. Description of the Prior Art

With an increasing number of transistors per unit area of electronic components, electronic components in operation generate an increasingly great amount of heat. In addition, operating frequency of electronic components is becoming higher, and thus switch loss arising from On/Off operation of transistors in operation accounts for the increase in heat generated by electronic components. Rapid development of semiconductor processes and IC packaging boosts the computation speed of chips greatly, and in consequence heat generated by chips in operation increases with clock frequency. Heat generated in the aforesaid manner can lower the operating speed of chips and even lessen the life of chips, when handled improperly. A conventional method for fabricating heat pipes comprises the steps of providing a heat pipe made of any material with high thermal conductivity;

inserting a plastic rod into the heat pipe so as to provide a fixed-gap clearance between the plastic rod and the wall of the heat pipe;

filling the fixed-gap clearance between the plastic rod and the wall of the heat pipe with copper powder;

forming a capillary structure (also known as a wick) by sintering, gluing, filling, and deposition;

separating the plastic rod from the heat pipe;

introducing a working fluid into the heat pipe and then leaving the heat pipe in vacuum;

closing the other end of the heat pipe.

Referring to FIGS. 1 and 2, which are an exploded view and a perspective view of a conventional heat-dissipating module respectively, a heat-dissipating module 1 comprises a heat-dissipating fin set 11 and at least one heat pipe 12. The heat-dissipating fin set 11 comprises a plurality of heat-dissipating fins 111 and a base 112. The heat-dissipating fins 111 are engaged with one another and soldered to a surface of the base 112. At least one through hole 113 is formed in the heat-dissipating fins 111 and penetrated by the heat pipe 12. A groove or a coupling hole to be penetrated by the heat pipe 12 and corresponding in position to the point of soldering the base 112 and the heat-dissipating fms 111 together is formed on the base 112. The heat pipe 12 is a known bent pipe or a known U-shaped pipe (and therefore the description thereof is omitted herein).

To perform heat dissipation with the conventional heat-dissipating module 1, heat generated by a heat-generating source 14 is transferred to the base 112 via the contact between the heat-generating source 14 and a plane of the bottom of the base 112, and then transferred to the heat-dissipating fin set 11 via the heat pipe 12. However, transferring heat from the heat-generating source 14 to the base 112 and then to the heat pipe 12 rules out the possibility of immediate contact between the heat pipe 12 and the heat-generating source 14. In addition, efficiency of heat transfer is greatly reduced due to thermal resistance, because a gap is likely to appear between heat-dissipating components coupled to one another.

Hence, the drawbacks of the prior art are as follows:

1. high production costs;
2. heat-dissipating components are insecurely coupled to one another and therefore a gap is likely to appear therebetween;
3. problems with thermal resistance; and
4. components have to be separately produced before assembly, and thus production is inefficient.

Accordingly, the inventor of this patent application and related manufacturers need urgent solution to overcome the drawbacks of the aforementioned prior art.

SUMMARY OF THE INVENTION

In view of the drawbacks of the aforementioned prior art, the inventor searched for related data, conducted comprehensive evaluation and contemplation, repeatedly performed run tests and made corrections based on the inventor's years of experience in the art, and eventually devised the present invention.

Accordingly, to solve the drawbacks of the aforementioned prior art, it is a primary objective of the present invention to provide a method for forming a heat pipe, whereby a heat pipe is processed to enable the heat pipe to be in immediate contact with a heat-generating source and thereby be capable of direct heat transfer.

Another objective of the present invention is to provide a heat pipe highly efficient in heat dissipation compared to conventional heat pipes.

In order to achieve the above and other objectives, the present invention provides a method for forming a heat pipe. The method comprises the steps of: severing a heat pipe according to required length such that the heat pipe comprises a closed end, a contact section, and a closed portion, wherein the closed end and the closed portion are provided with a capillary structure; closing one of the two ends of the heat pipe; introducing a working fluid into the heat pipe and then leaving the heat pipe in vacuum; closing the other end of the heat pipe so as to finalize the heat pipe; cutting axially the contact section into a plurality of parts, bending the parts outward, thereby providing the contact section with a relatively large area for contact or coupling with a heat-generating source. Heat is directly transferred from the heat-generating source to the heat pipe via the contact section, thereby enabling heat transfer and heat dissipation.

Accordingly, the present invention has the following advantages:

1. free of thermal resistance
2. space-saving
3. cost-saving
4. ease of assembly
5. efficient heat dissipation

DETAILED DESCRIPTION OF THE PREFERRED EMBODIMENTS

In order to achieve the aforesaid objectives and advantages, the technical means employed, structure, features, and functions of the present invention are illustrated with the appended drawings and preferred embodiments.

Figure 1:
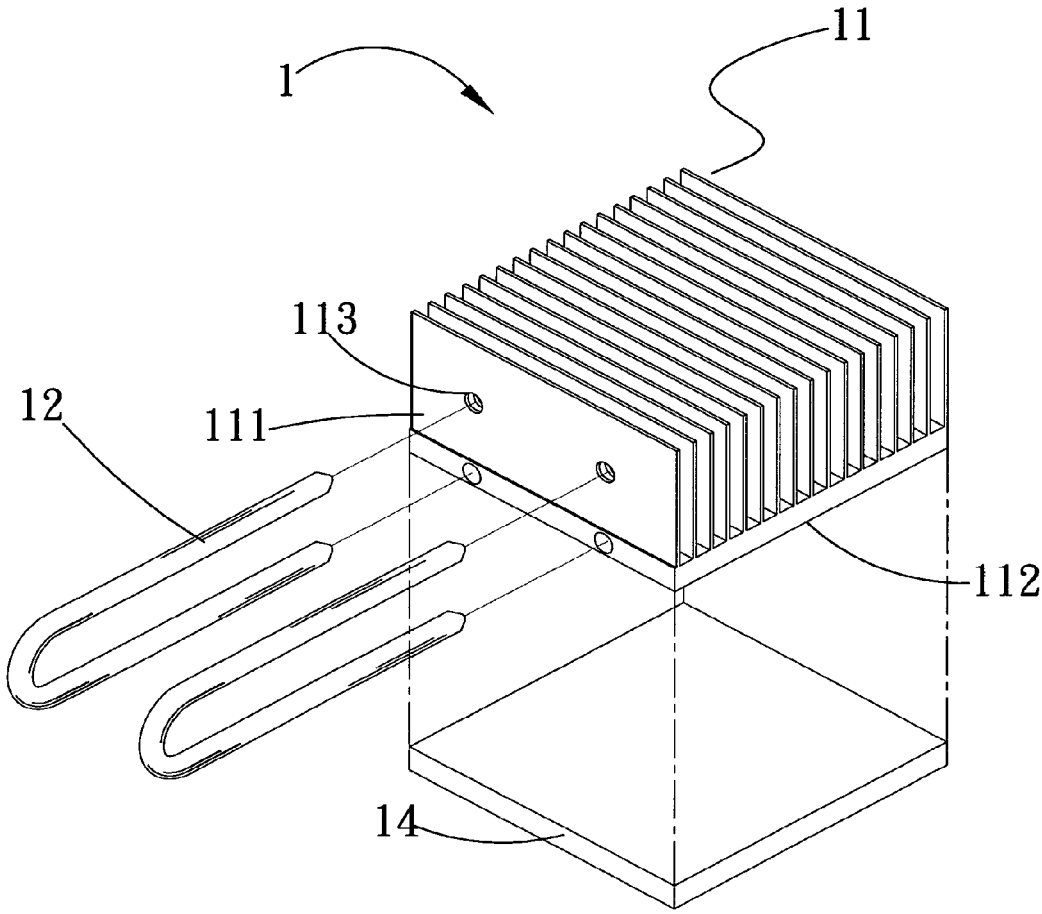
Fig. 1(PRIOR ART)
FIG. 1 (PRIOR ART) is an exploded view of a conventional heat-dissipating module.
Figure 2:
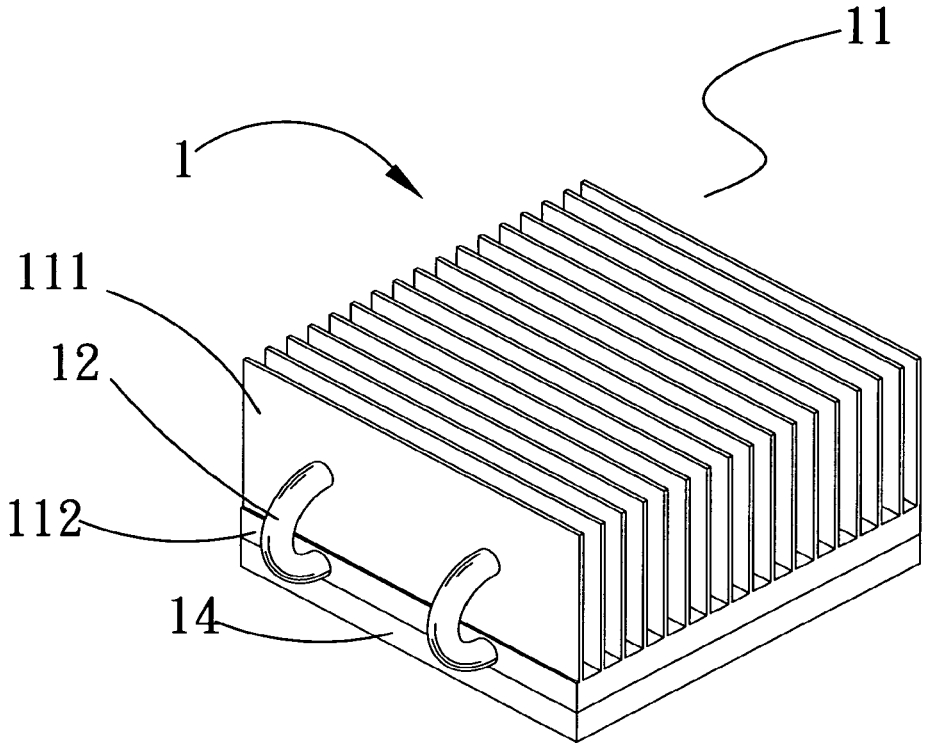
Fig. 2(PRIOR ART)
FIG. 2 (PRIOR ART) is a perspective view of a conventional heat-dissipating module.
Figure 3:
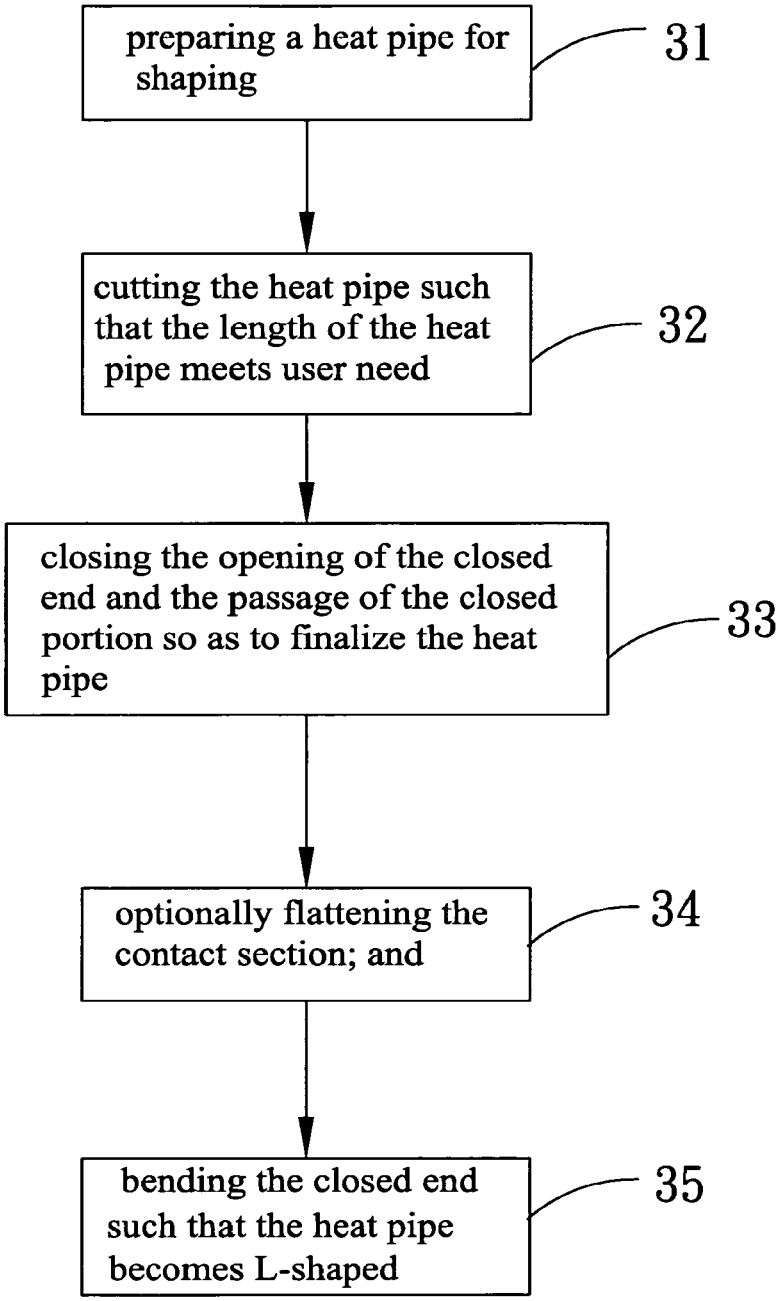
FIG. 3 is a flow chart of a method for forming a heat pipe in a preferred embodiment according to the present invention.
Figure 4:
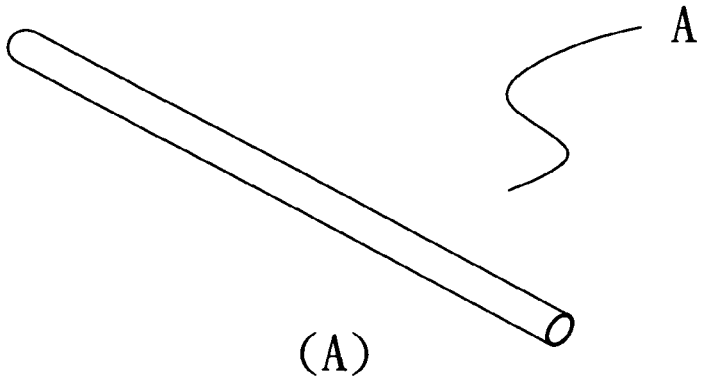
FIG. 4A is a perspective view of the heat pipe in the preferred embodiment according to the present invention.
FIG. 4B is a schematic view of the processed heat pipe in the preferred embodiment according to the present invention.
FIG. 4C is a schematic view of the processed heat pipe in the preferred embodiment according to the present invention.
FIG. 4D is a schematic view of the processed heat pipe in the preferred embodiment according to the present invention.
Figure 4:
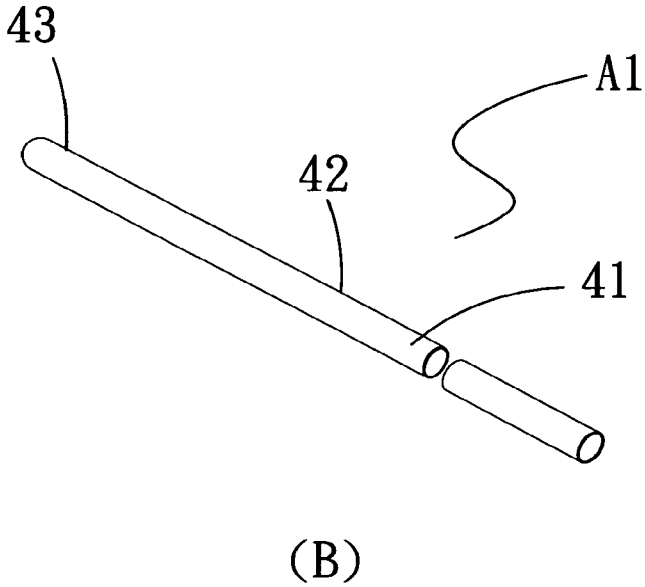
Figure 4:
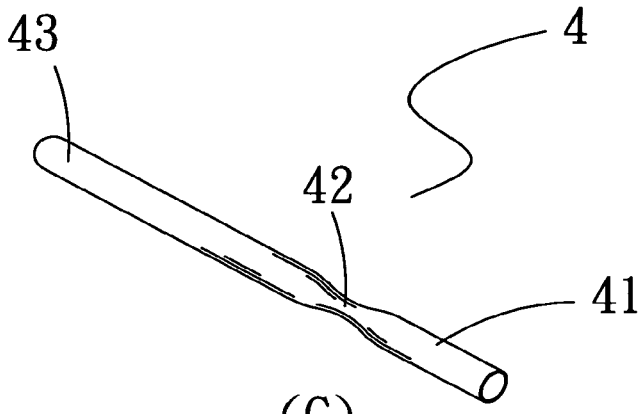
Figure 4:
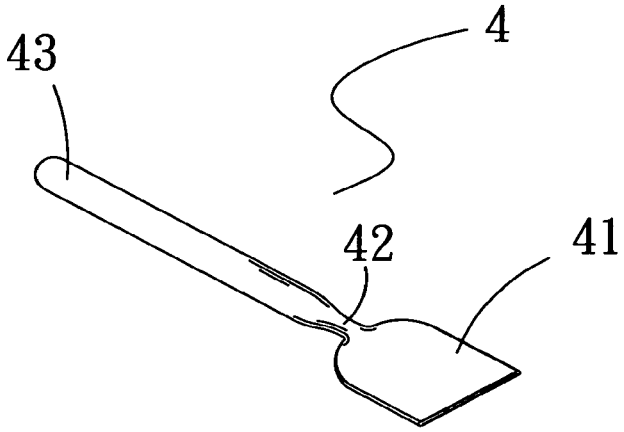
Figure 5:
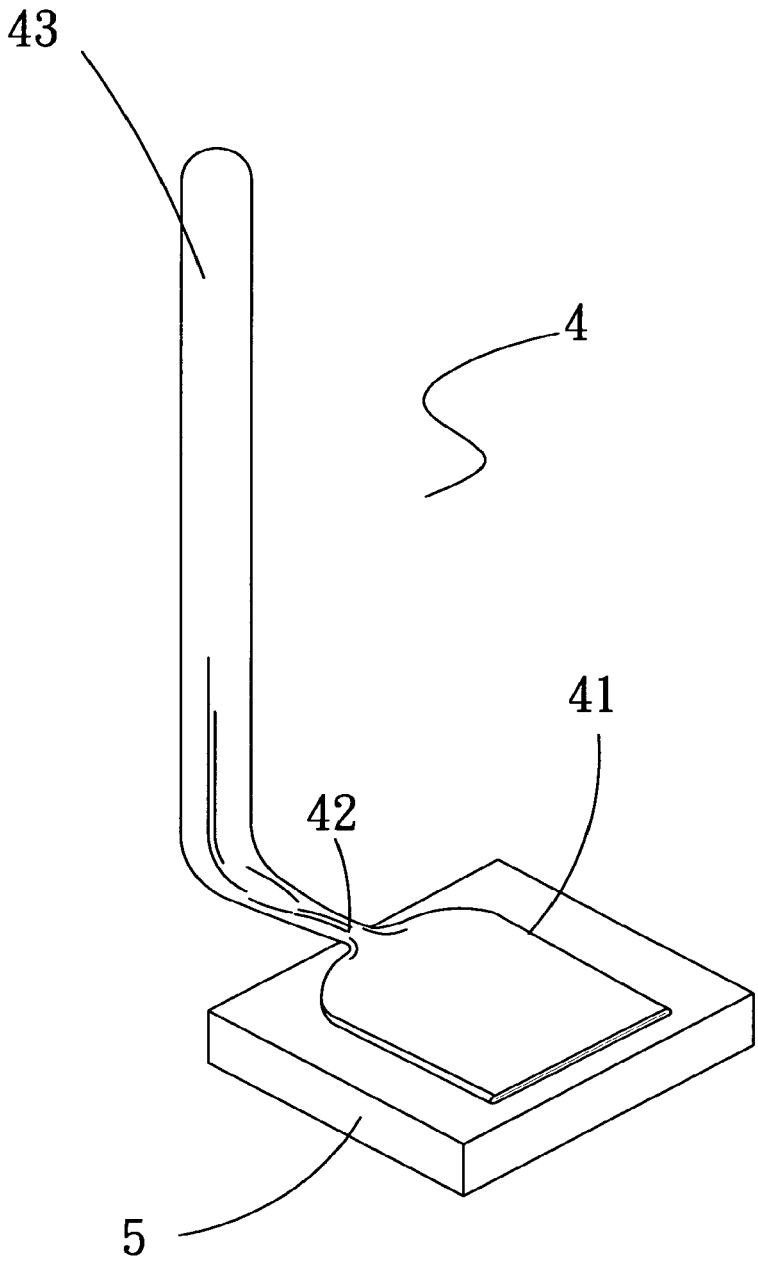
FIG. 5 is a schematic view of application of the heat pipe in the preferred embodiment according to the present invention.

Referring to FIG. 3, which is a flow chart of a method for forming a heat pipe in a preferred embodiment according to the present invention, a heat pipe is processed in the following steps:

Step 31: preparing a heat pipe for shaping (as shown in FIG. 4A);

Step 32: cutting the heat pipe such that the length of the heat pipe meets user need (as shown in FIG. 4B);

the heat pipe A is cut according to user need so as to provide the heat pipe A1 to be processed; a closed end 43, a closed portion 42, and a contact section 41 are defined in the heat pipe A1 to be processed;

Step 33: closing the opening of the closed end and the passage of the closed portion so as to finalize the heat pipe (as shown in FIGS. 4B and 4C);

the length of the heat pipe A1 required to finalize the closed end 43 is determined; the opening of the closed end 43 and the passage of the closed portion 42 are closed so as to finalize the heat pipe 4 (internally provided with a capillary structure (also known as a wick) and a working fluid in vacuum, which were disclosed in the prior art and therefore are omitted herein);

Step 34: optionally flattening the contact section (as shown in FIG. 4D);

the contact section 41 is flattened to increase the contact area thereof and thereby enhance the efficiency and speed of heat transfer;

Step 35: bending the closed end such that the heat pipe is L-shaped (as shown in FIG 5);

the closed end 43 is bent by 90° and the heat pipe 4 becomes L-shaped, such that immediate contact between the contact section 41 and the heat-generating source 5 enables heat transfer.

Figure 6:
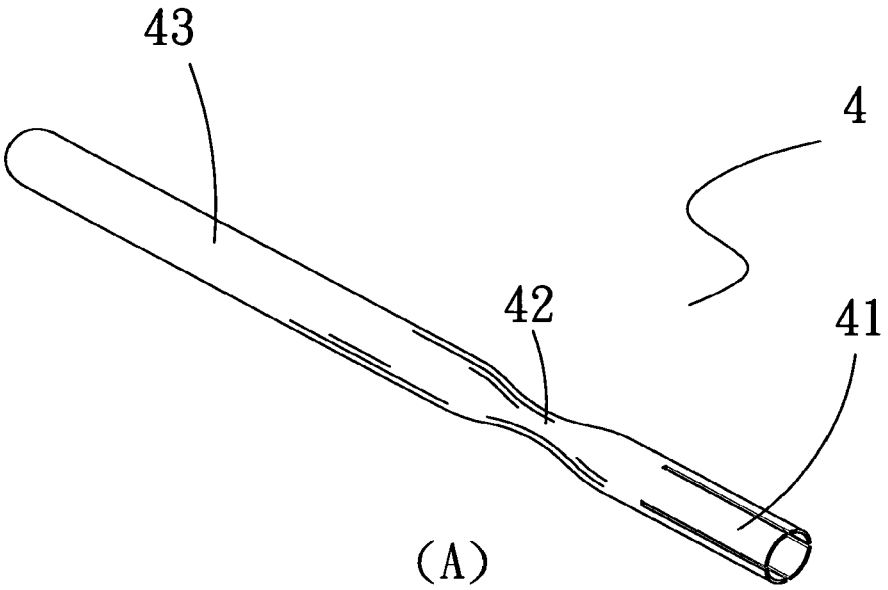
FIG. 6A is a schematic view of the shaped heat pipe in another preferred embodiment according to the present invention.
FIG. 6B is a schematic view of the shaped heat pipe in the other preferred embodiment according to the present invention.
Figure 6:
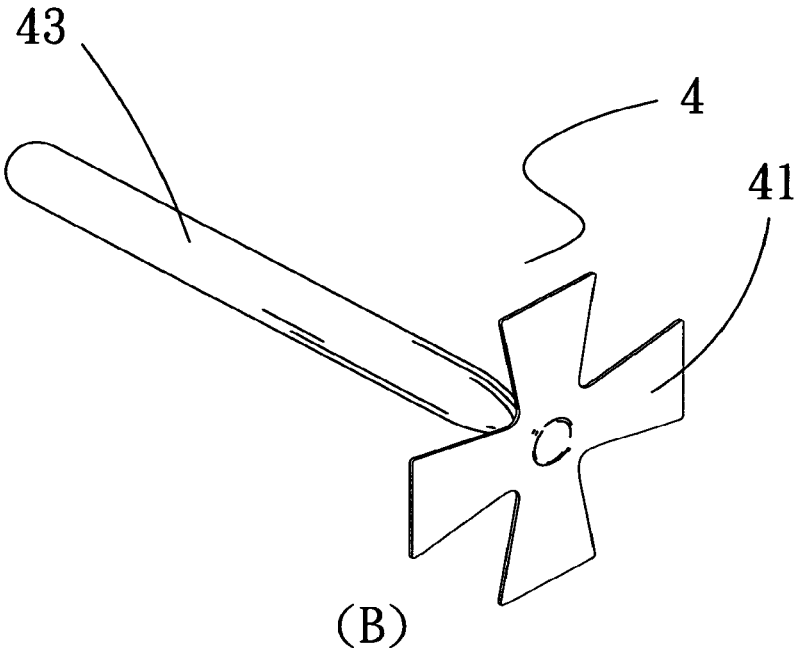
Figure 7:
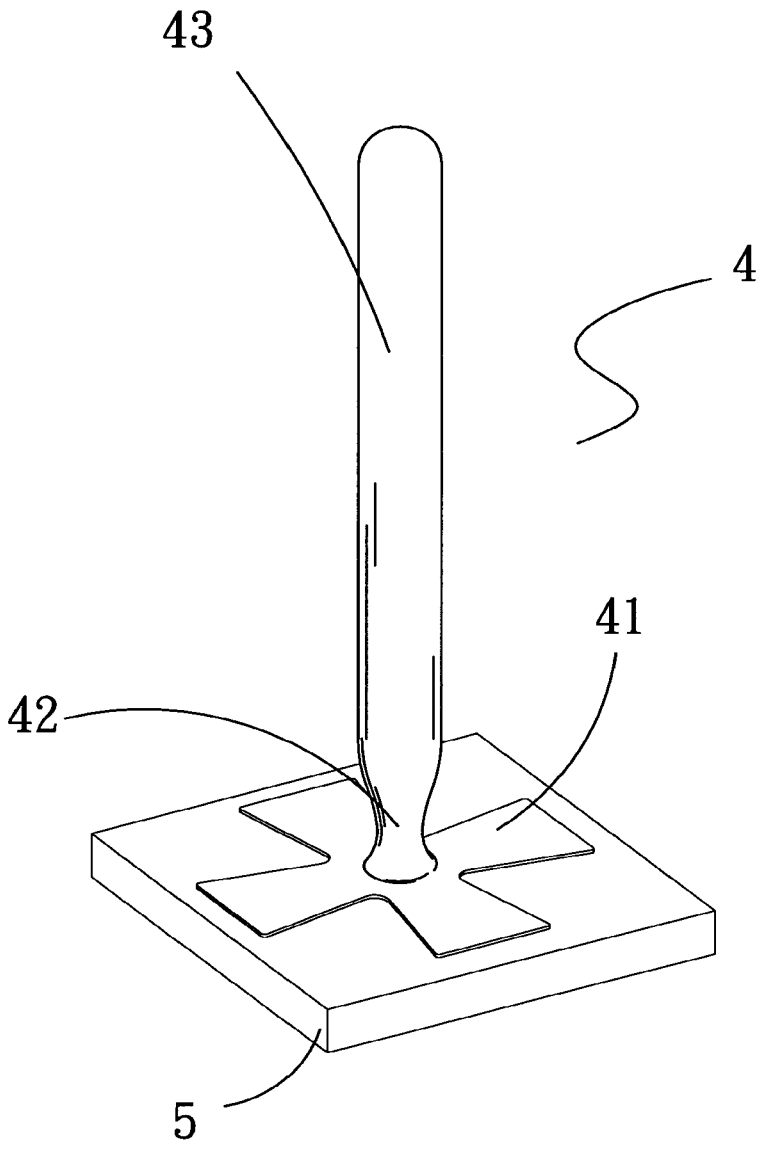
FIG. 7 is a schematic view of application of the heat pipe in the other preferred embodiment according to the present invention.

Referring to FIGS. 6A, 6B, and 7, the contact section 41 of the heat pipe 4 is axially cut into a plurality of equal parts (as shown in FIG. 6A). The present invention discloses cutting the contact section 41 into four equal parts, though it is also feasible to cut the contact section 41 into six, eight or more equal parts. Afterward, the equal parts of the cut contact section 41 are bent outward to assume divergent shapes, for example, a cruciform shape (as shown in FIG. 6B). Unfolding the contact section 41 in divergent patterns, such as a cruciform pattern, increases the area of contact between the contact section 41 and the heat-generating source 5. As a result, the contact section 41 of the heat pipe 4 may be directly disposed on the heat-generating source 5 to allow heat transfer to take place smoothly and swiftly.

Figure 8:
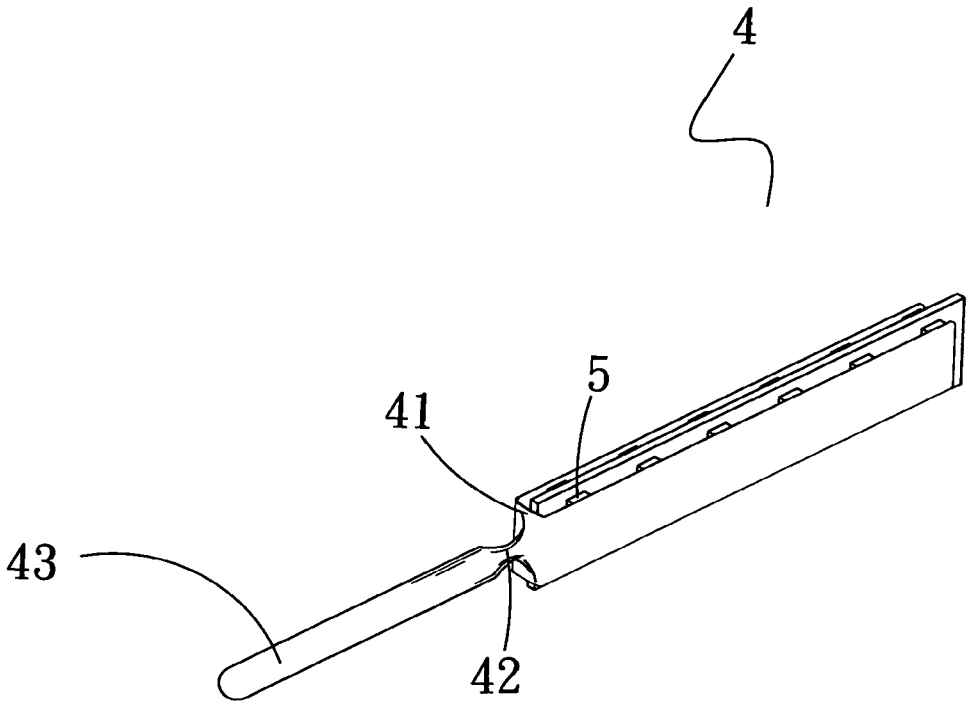
FIG. 8 is a schematic view of application of the heat pipe in the other preferred embodiment according to the present invention.

Referring to FIG. 8, which is a schematic view of application of the heat pipe in the other preferred embodiment according to the present invention, the contact section 41 is axially cut into a plurality of equal parts to be in immediate contact with a plurality of heat-generating sources from which heat is transferred to the closed end 43 via the contact section 41 so as to enable heat dissipation.

The aforesaid preferred embodiments reveal that the present invention has the following advantages and effects:

1. Immediate contact with a heat-generating source allows heat transfer and heat dissipation to take place without any other heat-dissipating component;
2. free of thermal resistance;
3. cost-saving;
4. speeds up production; and
5. space-saving.

The aforesaid embodiments merely serve as the preferred embodiments of the present invention but are not intended to limit the present invention. It will be apparent to those skilled in the art that all equivalent modifications or changes made, without departing from the spirit and the technical concepts disclosed by the present invention, should fall within the scope of the appended claims.

Summarizing the above, the heat pipe and the method for forming the same of the present invention is efficacious, has high industrial applicability, and meets the conditions for patentability. Hence, the applicant files the application for a patent. The applicant would appreciate, if a patent is issued to the application. An examiner should not hesitate to write and instruct the applicant to answer a question about the application document, and the applicant will spare no effort to follow instructions given by the examiner.

The invention claimed is:

1. A method for forming a heat pipe, comprising the steps of:

preparing the heat pipe having two ends, one closed end and an opening at another end;

cutting the heat pipe to a length according to user need;

forming a closed portion between the closed end and the opening, and forming a contact section between the closed portion and the opening;

shaping said contact section by flattening to provide said contact section with an increased surface area for immediate contact with a heat-generating source;

wherein said contact section is axially cut along the length thereof into a plurality of contact sections; and wherein said plurality of contact sections are bent outward to assume a divergent shape.

2. The method of claim 1, wherein said closed end is bent above said closed portion to become L-shaped.

* * * * *